US006589056B2

(12) United States Patent
Mc Govern

(10) Patent No.: US 6,589,056 B2
(45) Date of Patent: Jul. 8, 2003

(54) HAND HELD, HAND OPERATED, MECHANICAL, ROSARY PRAYER SEQUENCE SYMBOL PROMPTER

(76) Inventor: James R. Mc Govern, 63B Independence Ct., Yorktown Heights, NY (US) 10598

( * ) Notice: Subject to any disclaimer, the term of this patent is extended or adjusted under 35 U.S.C. 154(b) by 61 days.

(21) Appl. No.: 09/850,447

(22) Filed: May 7, 2001

(65) Prior Publication Data

US 2002/0164566 A1 Nov. 7, 2002

(51) Int. Cl.[7] ..... G09B 19/00
(52) U.S. Cl. ..... 434/246
(58) Field of Search ..... 434/245, 246, 434/365; 235/106, 113, 123, 128, 133 R, 140–141, 134–136; 428/3; 63/3–4, 7–8

(56) References Cited

U.S. PATENT DOCUMENTS 2,187,664 A * 1/1940 Rogus ..... 235/121
2,461,130 A * 2/1949 szaj ..... 235/123
2,675,910 A * 4/1954 Rasmussen et al. ..... 206/19
2,717,737 A * 9/1955 Hoelscher ..... 235/106
2,730,816 A * 1/1956 Garrett ..... 434/246
2,781,591 A * 2/1957 Bufalino ..... 434/246

* cited by examiner

*Primary Examiner*—Kim Nguyen

(57) ABSTRACT

A hand held mechanical Rosary prayer sequence symbol prompter has a circular enclosure that carries 6 non-similar geometric shaped counting symbols and a circular shaped counting symbol, in its top cover, a hand ratcheted, rotateable, 60 tooth counting wheel that carries a radially aligned cam that can effect symbol hold down, and release upward, into a counting mode, circular symbol mechanical apparatus for causing the 6 symbols to become reset, in the hold down mode, mechanical apparatus for resetting the circular symbol in the hold down mode, and a Rosary that is visible while carried in the prompter's bottom compartment.

10 Claims, 7 Drawing Sheets

FIG. 10
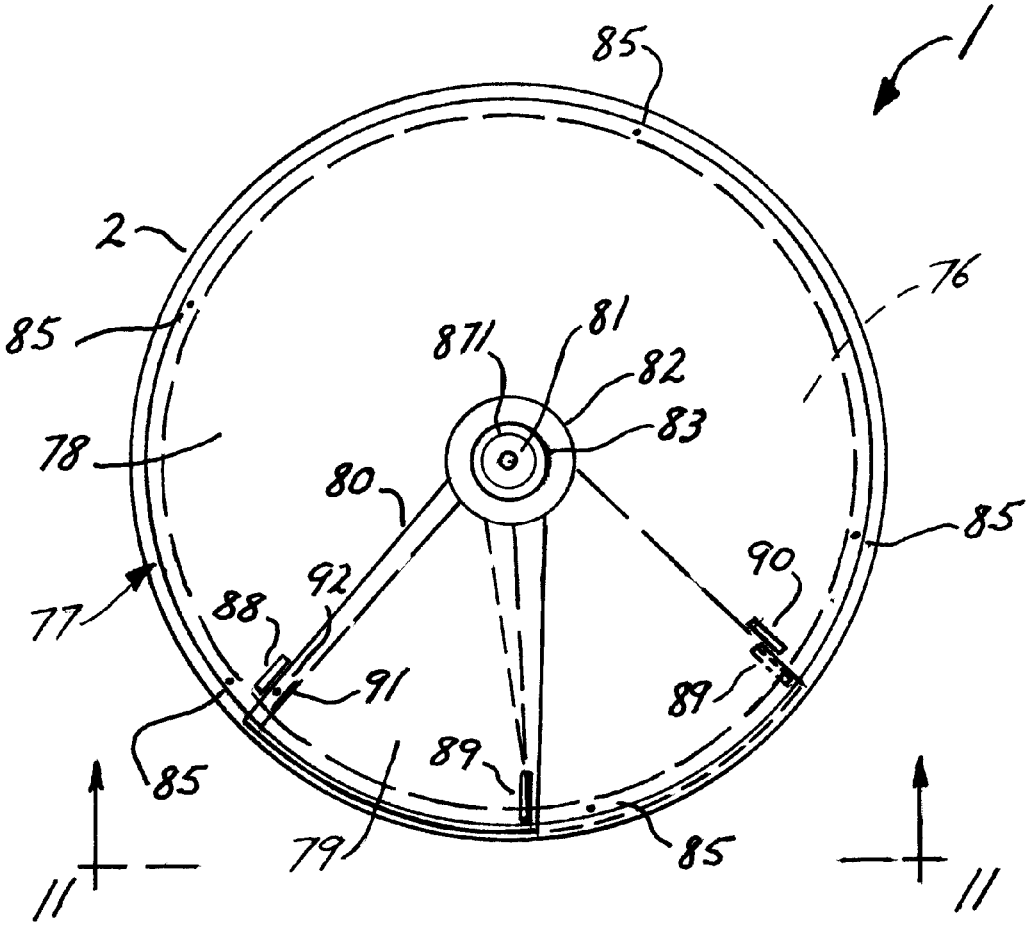
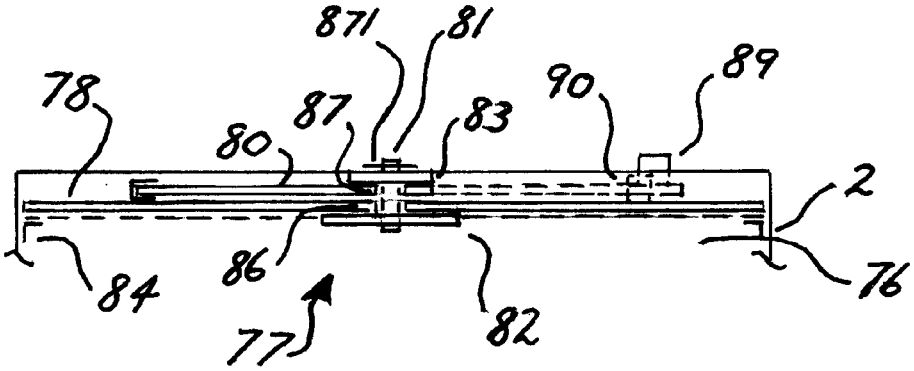
FIG. 11

HAND HELD, HAND OPERATED, MECHANICAL, ROSARY PRAYER SEQUENCE SYMBOL PROMPTER

CROSS REFERENCE TO RELATED APPLICATION

"Not Applicable"

STATEMENT REGARDING FEDERALLY SPONSORED RESEARCH OR DEVELOPMENT

"Not Applicable"

REFERENCE TO MICROFICHE APPENDIX

"Not Applicable"

BACKGROUND OF INVENTION

This prompter relates generally to the field of inventions that are used to help the user remember his place, where numerous and repeated steps are required as a matter of course in performing or reciting a known sequence of acts.

More specifically it relates to devices used for keeping track of prayers said in a sequence.

State of The Art could never supplant use of the Rosary, a string of beads provided for keeping track of the prayers of the Rosary.

However, often, especially in todays busy life styles, one finds himself having to "go back and pick up where he left off" in saying the prayers of the Rosary because of the flow of a day's activity. And one is often faced with the question "where was I"?

BRIEF SUMMARY OF THE INVENTION

It is to this end that the instant invention is directed, and it is therefore the object of the invention to provide a mechanical prompter that will continuously represent one's "place" in saying the Rosary.

It is also an object of the invention to provide a prompter that indicates by geometric shape specific parts of the Rosary prayer so that one can identify his place by feel, that is without looking at the prompter.

And a further object of the invention is to provide a mechanical counting prompter that is held and actuated by hand.

And another object of the invention is to provide a mechanical prompter that requires physical effort to operate in the performance of a devotional work.

Other objects of the invention will become apparent or obvious as this description thereof progresses.

In order to accomplish the above and related objects of the invention, its embodied form could be produced by one's reference to the accompaning drawings, keeping in mind that changes could be made in the actual construction at as it is shown and described within the scope of the appended claim.

Figure 1:
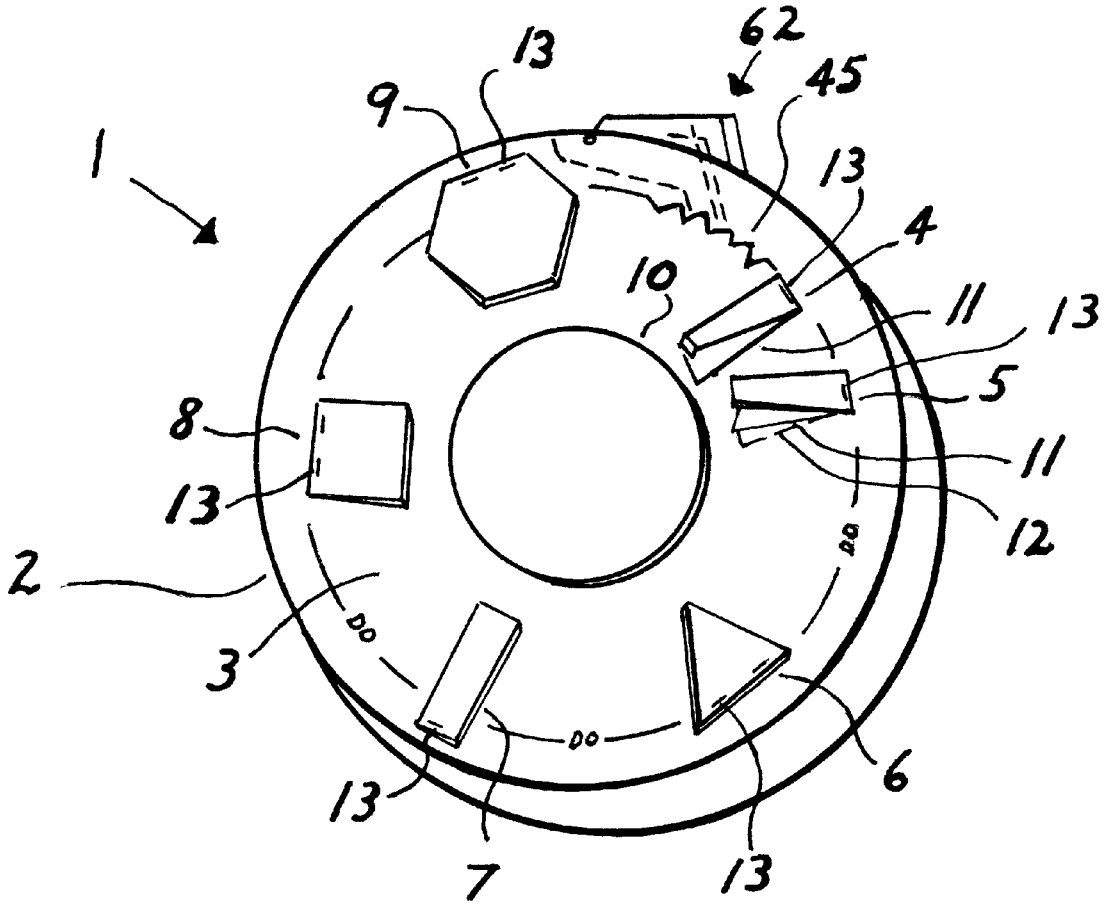
FIG. 1 is a plan view drawing of the invention that depicts the concept of providing 6 straight sided geometrically shaped counting symbols, and a circular center reset push button counting symbol, all of which are mounted moveably recessed in the domed top of the prompter, and a side mounted device actuating push button.

The upper part of the drawing shows a frontal elevation of a typical straight sided symbol's reset lever support bracket.

Figure 5:
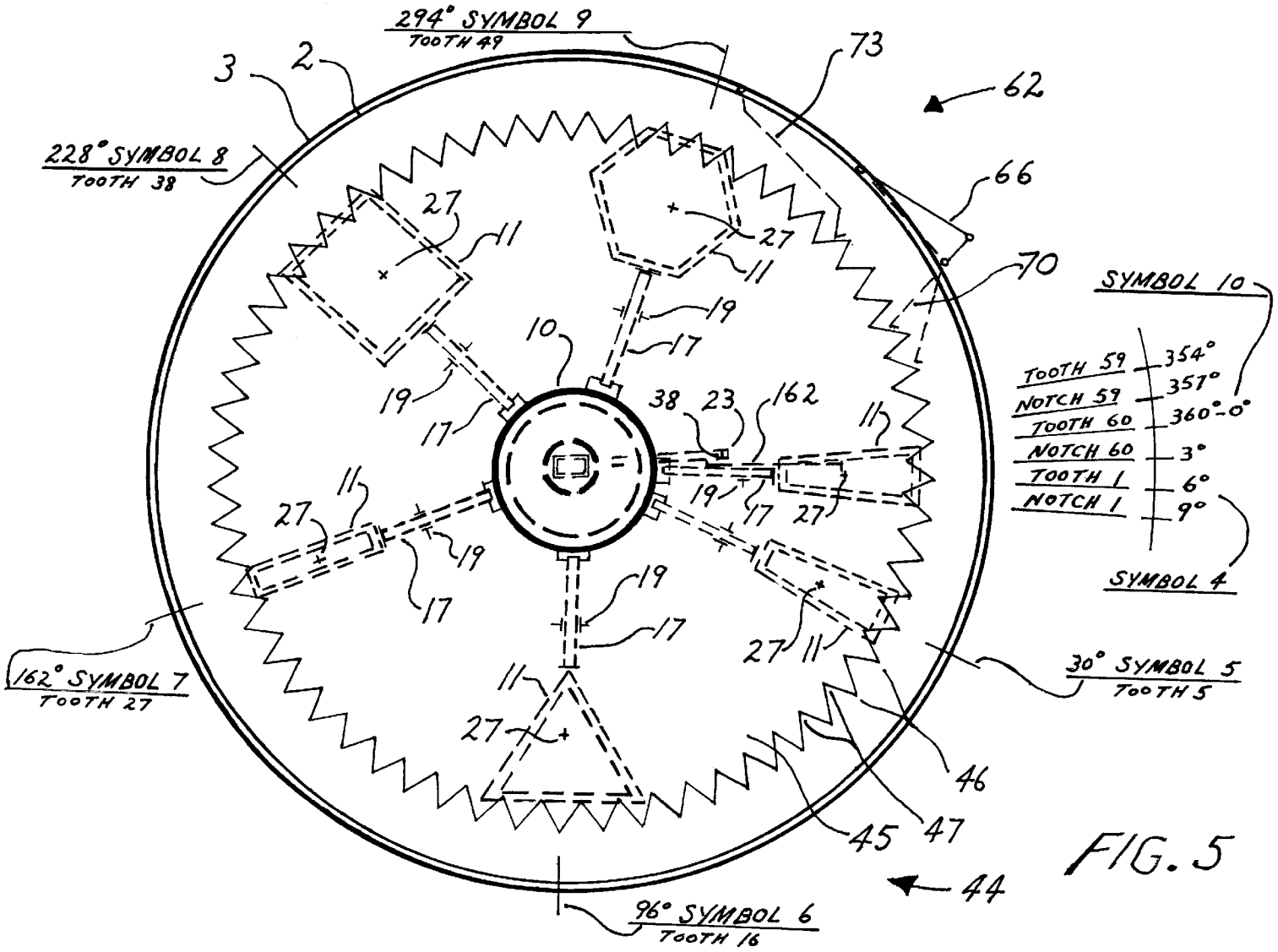

FIG. 5 is an enlarged plan view of the prompter counting wheel, the prompter counting symbols, the counting wheel's ratchet and pawl propulsion mechanisms, and also shows the radius line on the counting wheel specified for locating the point of hold down and release for each symbol.

Figure 6:
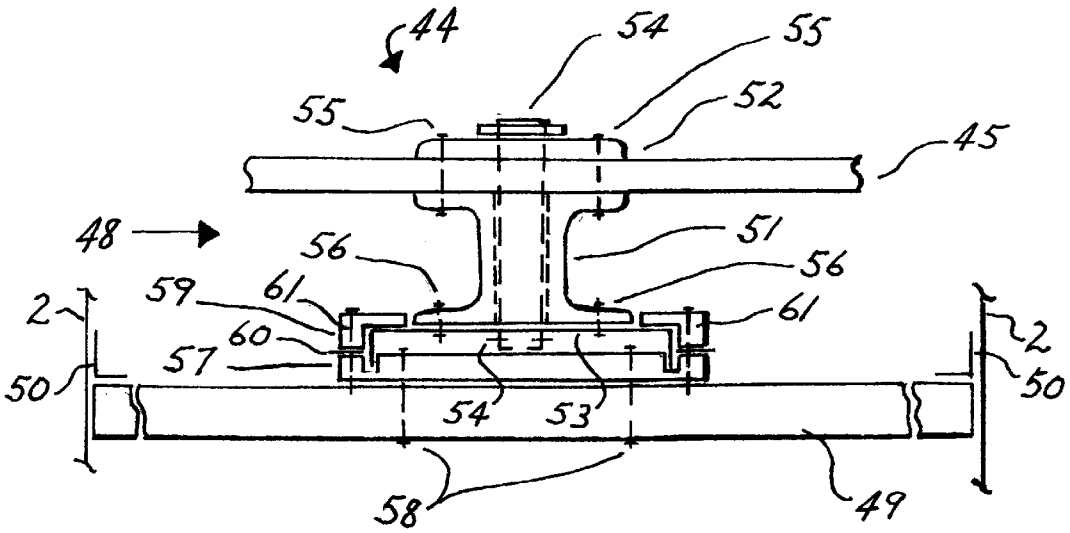

FIG. 6 is an enlarged view of the prompter's counting wheel bearing and structural support assembly.

Figure 7:
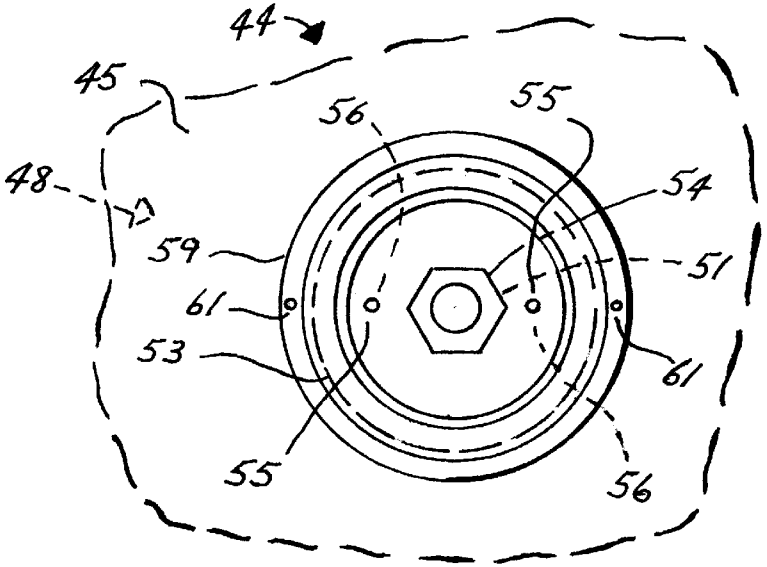

FIG. 7 is an enlarged top view of the prompter's counting wheel bearing and structural support assembly.

Figure 8:
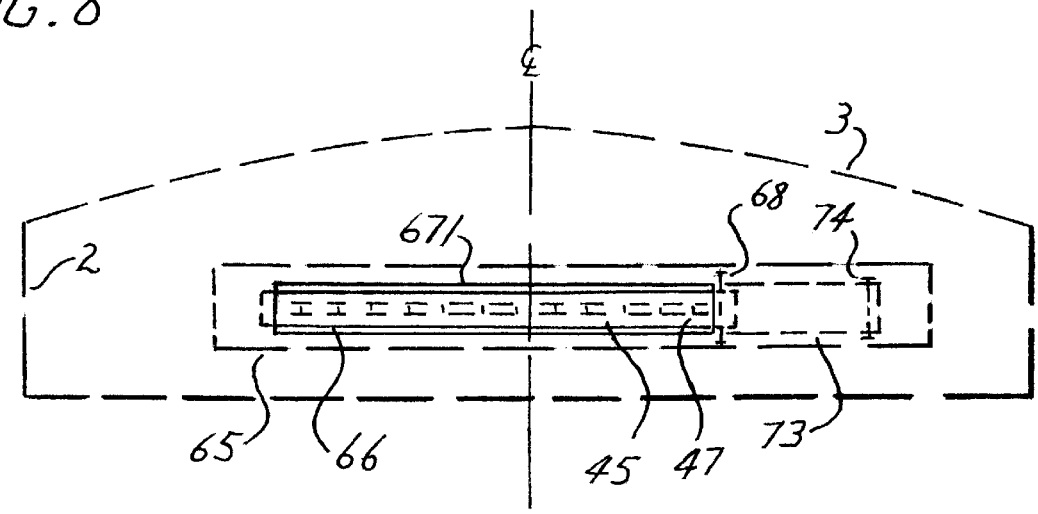

FIG. 8 is a side elevation drawing of the prompter that shows the placement of the prompter ratchet and pawl levers as they are supported to a base plate that is fastened to the interior surface of the prompter enclosure and protrude through a slot in the side of the prompter enclosure.

Figure 9:
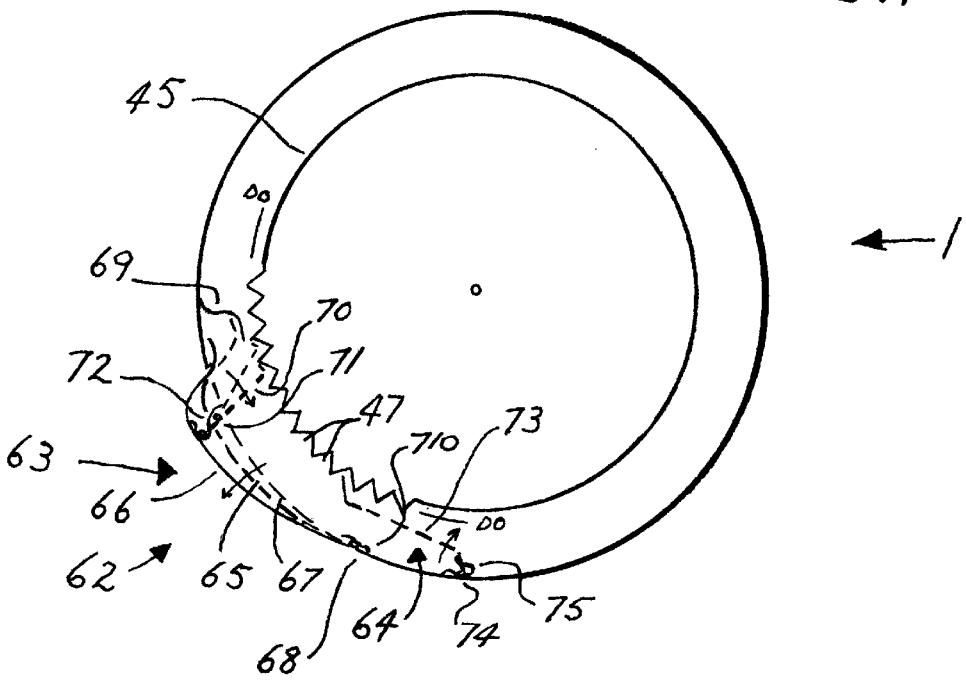

FIG. 9 is a plan view of the prompter ratchet and pawl counting wheel propulsion assembly.

FIG. 10 is a plan view of the prompter's bottom Rosary compartment that shows the compartments fixed transparent clear plastic covering pane with a V shaped opening cut into it and a V shaped moveable gate cover that can be slid over and off the V shaped opening.

FIG. 11 is a section through line 11—11 of FIG. 10 depicting a side elevation of the prompter compartment covering pane and the sliding V shaded gate that covers the Rosary access opening in the compartment cover.

DETAILED DESCRIPTION OF THE INVENTION

Proceed to build a hand held, hand operated, mechanical prompter with geometric shapes that while normally recessed in the domed face of the device, can be actuated into a raised attitude and serve as counting symbols in a prayer sequence and then reset into their original recessed positions.

Now, with reference to FIG. 1, provide the prompter 1 with a circular enclosure 2 that carries six hinged straight sided geometrically shaped counting symbols in its dome 3 top, including two trapezoidal shaped symbols, 4 and 5, a triangular shaped symbol 6, a rectangular shaped symbol 7, a square shaped symbol 8, a hexagonally shaped symbol 9, and a circular shaped symbol 10.

Figure 2:
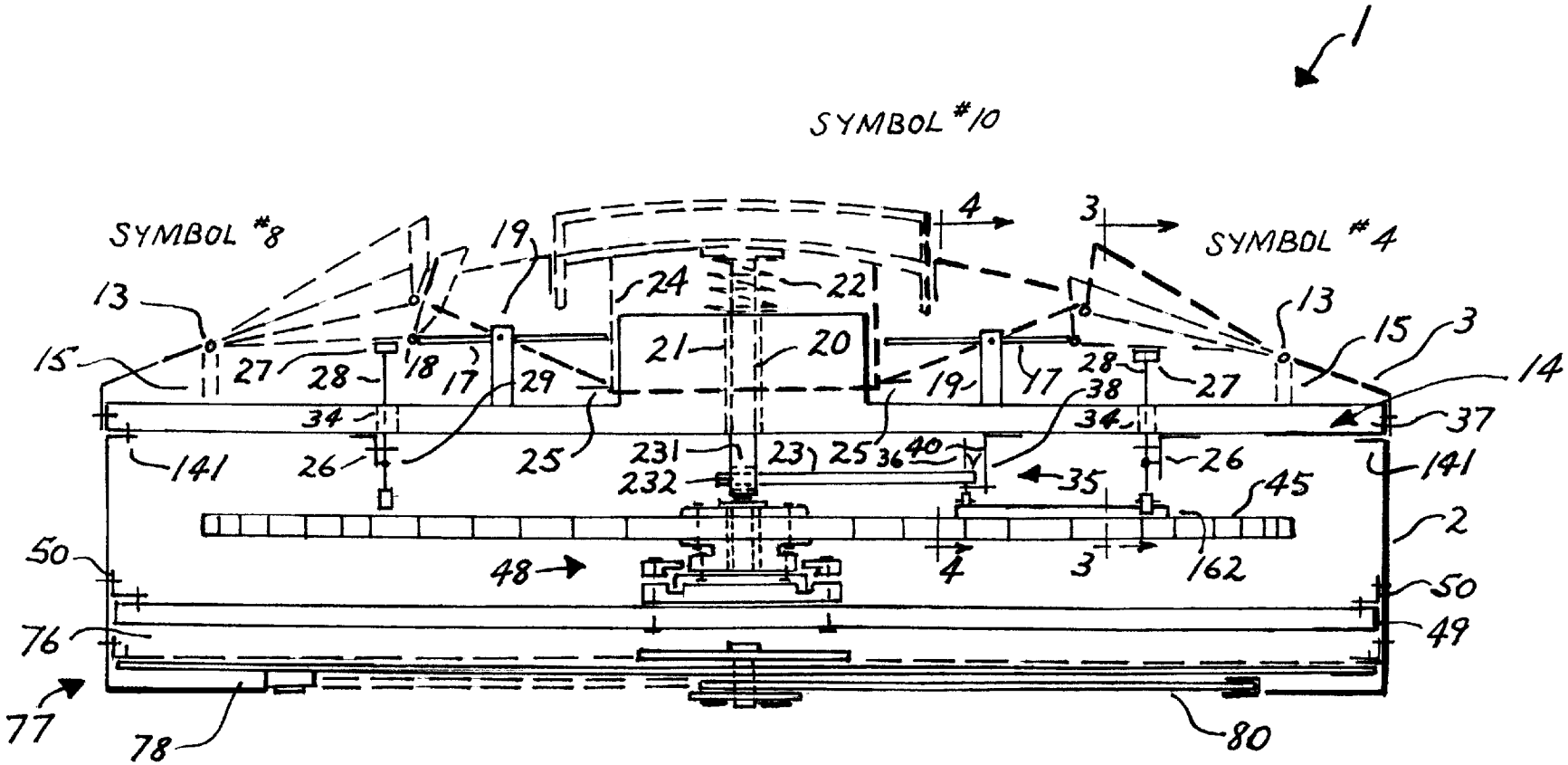
FIG. 2 is an enlarged elevation drawing that shows an interior view of device components, including a structural frame, the domed top with counting symbols in simulated recess and elevated modes, symbol hold, release and reset elements, the circular center symbol hold and release mechanism, a notched counting wheel, a prompter enclosing cylinder, and a bottom of prompter Rosary compartment.

Continuing, refer to FIG. 2 and provide

- a cut out 11 in the dome 3 for each symbol, that is for symbols 4, 5, 6, 7, 8, 9, and 10,
- a recess or open space 12 beneath each symbol so that they can fit down into the dome 3 during their non use,
- a hinge 13 fastener on each symbol, that is for symbols 4, 5, 6, 7, 8, and 9, at its circumference end,
- a prompter 1 structural frame 14 to support and carry prompter components,
- a vertical symbol fastening ring 15 that is supported to the top surface of the structural frame 14, to support the hinge 13 fastening of each symbol, that is symbol 4, 5, 6, 7, 8, and 9
- a tension spring 16, not shown, on each symbol's, that is symbol 4, 5, 6, 7, 8, and 9, hinge 13 fastening, disposed exerting upward clockwise pressure on its corresponding symbol, a reset lever 17 on each symbol, that is symbol 4, 5, 6, 7, 8, and 9, that is hinge fastened to the unfastened lower front end of the symbol.

Provide a U shaped pivot post bracket 19 for each reset lever 17. The lever 17 is hinge fastened to the tops of the U bracket's 19 vertical members. This can also be seen in FIG. 5.

The device's cylindrical enclosure 2 and the dome 3 could be made of plastic.

The dome 3 encloses and is carried fastened to the circular vertical edge of the prompter 1 structural frame 14.

The structural frame 14 is mounted on a horizontal lip 141 that is formed at the interior top of the cylindrical enclosure 2.

Continue reference to FIG. 2 and provide a flat headed rectangular shaped vertical shaft 20 support for circular symbol 10, and a rectangular vertical hole 21 in the center of frame 14, to stabelize shaft 20 from rotational travel as the circular symbol's 10 support travels up and down in the vertical hole 21.

Provide a coiled spring 22, carried between the symbol's top underside surface and the top of the frame 14, to provide upward pressure on the circular symbol 10.

Provide a vertical shaft 20 lever 23, carried extending horizontally out of a slot 231 in the bottom end of symbol 10 shaft 20.

The lever 23 provides a point of leverage on the circular symbol 10, in effecting its upward and downward movement The horizontal lever 23 is fastened in slot 231 by set screw 232, and is the upward travel limit for symbol 10.

Provide circular symbol 10 with a downward extending skirt 24 that carries six tabs 25 that extend horizontally outward from the bottom circumference of the skirt and that correspond to the six symbol reset levers 17 that are provided, one fastened to the bottom surface at the unfastened end of each of the six straight sided symbols, namely, symbol 4, 5, 6, 7, 8, and 9.

Note 1

Typically the six straight sided symbols, that is, symbol 4, 5, 6, 7, 8, and 9, are engaged by a cam that is carried on a counting wheel that is propelled by a ratchet and pawl mechanical counting wheel propulsion mechanism, (specified below), and released to an elevated mode for counting reference.

As a result the reset lever 17 of each elevated symbol, that is symbol 4, 5, 6, 7, 8, and 9, engages its corresponding tab 25 on the circular symbol skirt 24.

Then typically, in turn, the circular symbol 10 is engaged by the cam on the counting wheel, and is released upward.

As a result, the symbols tabs collectively lift the unfastened ends of the reset levers 17 upward, thus pushing each corresponding straight sided symbol back down into its original recessed mode. (end of note 1)

Figure 4:
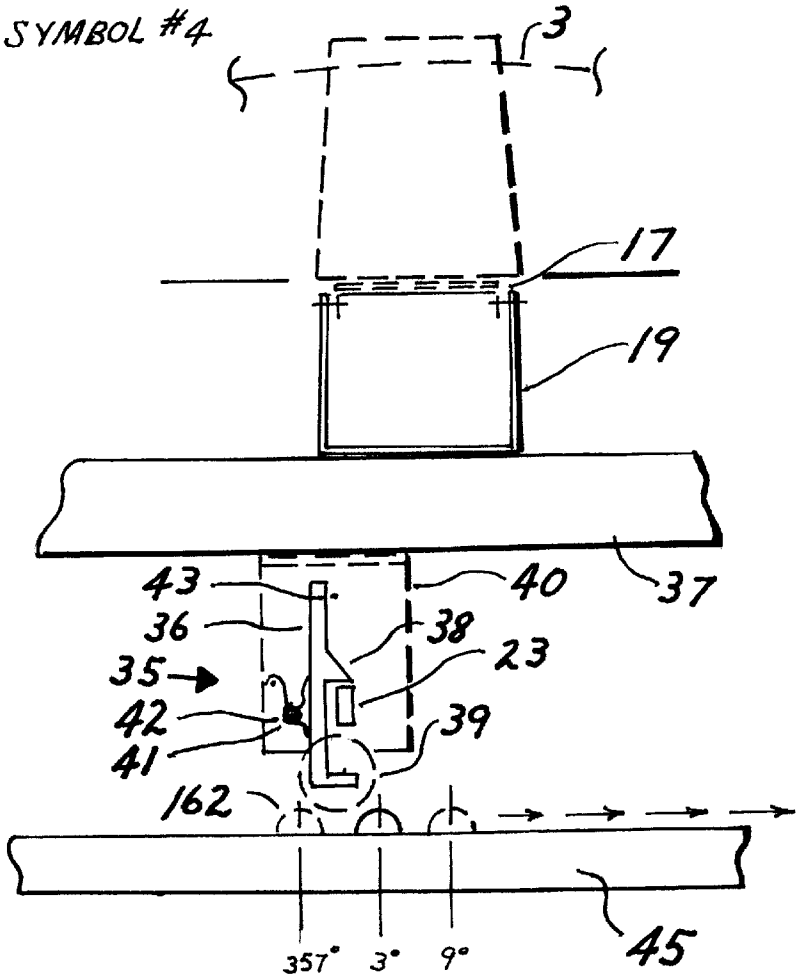
FIG. 4 is a section through line 4—4 of FIG. 2 depicting a frontal elevation of the circular push button counting symbol #10 hold and release mechanism that includes a graphic simulation of the disposition of the straight sided symbol in a recessed mode after the counting wheel cam has actuated the circular symbol's 10 hold and release mechanism and the symbol 10 has been reset by pressing it down manually.
Figure 3:
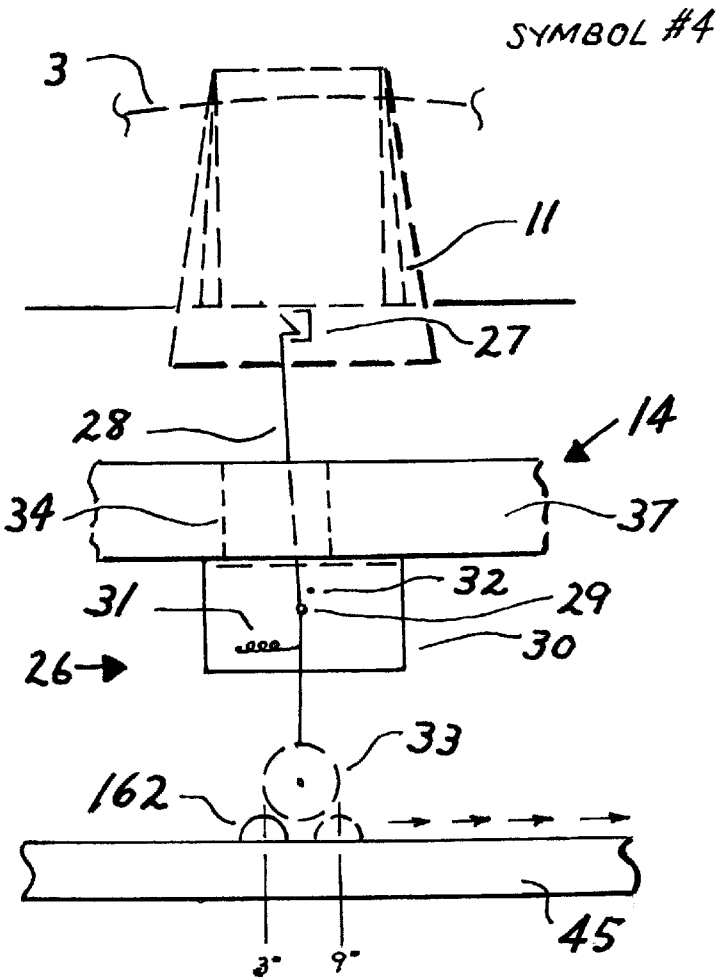
FIG. 3 is a section through line 3—3 of FIG. 2 depicting a frontal elevation of a typical straight sided counting symbol hold and release mechanism, -counting symbol #4 is shown-, that also provides a graphic simulation of the mechanism just prior to symbol release, that is, when a counting wheel cam is set to displace the symbol's hold down lever.

Now, with reference to FIG. 3 and FIG. 4, continue building and provide a typical straight sided symbol hold and release mechanism 26 for each straight sided symbol, that is for symbol 4, 5, 6, 7, 8, and 9.

Provide each straight sided hold and release mechanism 26 with

- a hold down hook 27, that resembles a short length of channel, and is fastened to the underside of the symbol,
- a hold down lever 28 that is carried on a pivot pin 29 that is set in the vertical member of an L shaped support angle 30 that is fastened by its horizontal member to the underside of structural frame 14 member 37.

Provide a tension spring 31 that is fastened by one of its ends to a pin set in the support angle 30 and is fastened by its other end to hold down lever 28.

The spring 31 exerts clockwise turning pressure on lever 28 to force its hooking engagement with hook 27, typically, to hold the symbol, that is 4, 5, 6, 7, 8, or 9, down.

Provide a turning limit pin 32, that is set in support angle 30 to control the lever's 28 clockwise turning stopping point and thereby achieve effective engagement of hook 27 by the hook shaped upper end of lever 28.

Provide a rotateable disk 33 mounted on the lower end of lever 28.

Provide a vertical slot 34 in member 37 of the structural frame 14 so that the lever 28 can oscillate back and forth where it passes through member 37.

Referring again to FIG. 2 and with continued reference to FIG. 4, while continuing the building process, provide a circular shaped symbol 10 hold down and release mechanism 35 that is provided with the following:

- a circular shaped symbol 10 hold down lever 36 that embodies a hook 38, and carries a rotateable deflector disk 39 mounted on the lower end of the lever 36,
- a symbol 10 lever 36 support angle 40 that is fastened by its horizontal member to the underside of structural support 14 member 37,
- a lever 36 pivot pin 41 that is carried set horizontally in the angle's vertical member, with the lever 36 mounted rotateably on it 41,
- a lever 36 tension spring 42 that is mounted on the lever's 36 pivot pin 41 with one of its ends stabelized pinned to the horizontal surface of angle 40 and its other end engaging the vertical edge of the lever 36, while providing clockwise turning pressure on the lever 36, forcing it's hook 38 to engage the circular symbol's horizontally extending lever 23 and hold the symbol 10 in a recessed mode,
- a lever 36 turning limit pin 43 that is set in support angle 40's vertical member to control the lever's 36 clockwise turning stopping point to provide effective engagement of hook 38 with symbol 10's horizontal lever 23.

Continuing the building process refer to FIG. 5 and provide a prompter counting wheel assembly 44 that is provided with a counting wheel 45 that is controlably rotated by a ratchet and pawl propulsion mechanism as specified below, a counting wheel 45 that has 60 teeth 46 and 60 V shaped notches 47 cut into its peripheral edge and a symbol hold and release mechanism actuating displacement cam 162, that is provided fastened to the top surface of the prompter 1 counting wheel 45.

The 60 teeth of the wheel 45 correspond to 60 sequenced prayers typically said in one recitation of the Rosary.

In the building process, using the replica of the wheel 45 shown in FIG. 5, establish a correspondence between the prompters 0° radius line and the wheel's 60th. tooth.

Fasten cam 162 along the wheel's 3° radius line.

The 3° radius line corresponds to the wheel's 60th. peripheral V notch.

With continued reference to FIG. 5, provide for placement of each symbol, that is symbol 4, 5, 6, 7, 8, and 9, so that in its hinged 13 fastening to the frame 74 supported ring 15, its hold down hook 27 is aligned for engagement by the wheel 45 transported cam 162 in the following correspondence:

symbol 4, align hook 27 on prompter radius line 6°, wheel 45 tooth #1 symbol 5, align hook 27 on prompter radius line 30°, wheel 45 tooth #5 symbol 6, align hook 27 on prompter radius line 96°, wheel 45 toot #16 symbol 7, align hook 27 on prompter radius line 162°, wheel 45 tooth #27 symbol 8, align hook 27 on prompter radius line 228°, wheel 45 tooth #38 symbol 9, align hook 27 on prompter radius line 294°, wheel 45 tooth #49

Again, with reference to FIG. 5, provide placement of circular symbol 10 so that its horizontal lever 23 is aligned while it is held down by hook 38 on hold down lever 36, on the prompter's 0° radius line, which was placed in correspondence with the wheel's 45 60th. tooth 46.

Continue the building process, refer to FIG. 6 and FIG. 7, and provide a counting wheel assembly 44 sub assembly 48 that supports the wheel 45 and is provided with the following:

a structural base 49 that is carried, fastened at each of its ends by L shaped brackets 50 to the interior sides of the prompter 1 enclosure, (this can be seen in FIG. 2), a wheel spacer post 51, a spacer cap 52, a circular wheel bearing 53, a wheel post and bearing alignment bolt with end nuts 54, spacer post-wheel-spacer cap, thru bolts with end nut fasteners 55, spacer post and bearing thru bolts with end nut fasteners 56, a circular grooved bearing base plate 57, bearing base plate flathead countersunk thru bolts, inverted, with end nut fasteners 58, a wheel sub assembly containment ring 59, a containment ring spacer ring 60, and containment ring fastening screws 61.

The counting wheel 45, supported to the sub assembly 48, is rotateable on its bearing 53, in the groove of the bearing base plate 57.

The wheel 45 and sub assembly 48 are contained in rotational use by the superimposed containment ring 59, which is fastened to the base 49 fastened bearing plate 57.

Now, with reference to FIG. 8 and FIG. 9, provide a prompter 1 ratchet and pawl counting wheel 45 mechanical propulsion assembly 62.

In providing the assembly 62 provide a push button ratcheting mechanism 63 and a wheel rotational movement control pawl mechanism 64.

The assembly 62 is carried by a curved base plate 65 that is mounted on the interior surface of the prompter 1 enclosure cylinder 2 with the push button mechanism's 63 push button lever 66 protruding outward through an elongated slot 67 cut lengthwise in the side of the plate 65, and outward through a corresponding cut out 671 in the cylinder's 2 curved side.

The push button lever 66 is hinge 68 fastened by one of its ends to the interior surface of base plate 65.

The unfastened end of push button lever 66 travels between the interior surface of base plate 65 and travel limit bar 69.

A short ratcheting lever 70 is hinge 71 fastened to the interior surface of, and near the unfasternd end of the push button lever 66.

Provide push button lever 66 hinge 68 fastening with a tension spring 710 that provides counter clockwise turning pressure on lever 66.

Provide the short ratcheting lever's 70 hinge 71 fastening with a tension spring 72 that provides clockwise turning pressure on lever 70.

Provide the assembly 62 pawl mechanism 64 with a wheel holding lever 73 that is fastened by one end to the interior surface of base plate 65 by hinge 74.

Provide a pawl lever 73 hinge 74 fastening with a tension spring 75 that provides clockwise turning pressure on lever 73.

Provide a preset distance between the interior surface of base plate 65 and travel limit bar 69 so that when ratchet lever 66 travels the equivalent of that pre set distance, lever 70 moves wheel 45 a distance equal to 6° on the prompter's circumference and ratchet lever 70 moves from one V notch 47 to the next succeeding V notch 47, after it pushes the wheel 45 clockwise.

Proceeding with the building, refer to FIG. 10 and FIG. 11 and provide a prompter 1 bottom compartment 76 that will provide an enclosed space in which a set of Rosary Beads can be carried.

As shown in FIG. 10 provide a compartment enclosing window assembly 77 that includes a fixed clear plastic pane 78 that has a V shaped gate opening 79 cut out of its 78 circular shape, a V shaped gate pane 80 that is larger than and overlaps the gate opening 79, a threaded gate pin 81, a flat circular stabelizer base nut 82, a circular threaded gate pin retaining washer nut 83, a circular threaded lock nut 871, a compartment 76 circular, angular window base frame 84, window frame flat head thru bolts and nuts 85, a hole 86 in the center of plastic pane 78 and a mounting hole 87 in gate pane 80.

Fasten the window base frame 84 to the interior sides of the prompter 1 enclosure 2 by glueing.

Support pane 78 to the horizontal surface of window frame 84.

Fasten the pane 78 as shown in FIG. 10 by bolts and nuts 85.

As shown in FIG. 11 screw base nut 82 onto gate pin 81 and extend the pin up through hole 86 in pane 78.

Place gate pane 80 over pane 78, extending the pin 81 up through hole 87 in the 80 pane.

Screw retaining washer nut 83 onto pin 81 allowing enough clearance to permit semi-rotational movement of the gate pane 80 back and forth over the gate opening 79 in pane 78.

Screw threaded lock nut 871 onto pin 81 into stabelizing and locking contact with retaining nut 83.

With continued reference to FIG. 10 and FIG. 11 provide a compartment 76 gate pane 80 clockwise rotation stop 88.

The stop 88 could be a rectangular shaped piece of plastic that is glued to the top surface of the clear plastic panel.

Provide a V gate lever 89 for moving the V gate pane 80 on and off of the gate opening 79.

The lever 89 could be a rectangular shaped piece of plastic that is glued to the top surface of gate pane 80.

Provide a V gate pane counterclockwise rotation stop 90.

The stop 90 could be a rectangular shaped piece of plastic that is glued to the top surface of the clear plastic pane 78. Elements 88, 89, and 90 are to be positioned as shown in FIG. 10.

Finally, provide elements that will provide stability to the compartment's 76 gate pane 80 closure.

To this end provide a preferred embodiment comprised of a raised circular plastic mound 92 that is cast on the surface of and is an integral part of the clear plastic pane 78.

Complimentary to mound 92, provide a raised surface, in the form of a bar 91, that is aligned radially with respect to the V gate's pin 81, on the compartment side of the V gate pane 80, so that when the V gate is closed, that is moved toward clockwise rotation stop 88, the bar 91 encounters the mound 92 and is snapped over it 92, while the V gate 80 falls into a stabelized or held mode, and gate 80 closure, and compartment 76 containment are achieved. Elements 91 and 92 are to be located as shown in FIG. 10.

Use of the Invention

The prayer symbol Prompter follows the prayer sequence of the Rosary as follows:

at the 1st. actuation of the Prompter, trapezoidal symbol 4 is elevated—say Our Father prayer, at each subsequent Prompter actuation, that is the 2nd, 3rd, and 4th,—say a Hail Mary prayer, at the Prompter's 5th. actuation, trapezoidal symbol 5 is elevated—say Our Father prayer, at each subsequent Prompter actuation, that is the 6th. through the 15th,—say a Hail Mary prayer, at the Prompter's 16th. actuation, triangular symbol 6 is elevated—say Our Father prayer, at each subsequent Prompter actuation, that is the 17th. through the 26th,—say a Hail Mary prayer, at the Prompter's 27th. actuation, rectangular symbol 7 is elevated—say Our Father prayer, at each subsequent prompter actuation, that is the 28th through the 37th—say a Hail Mary prayer, at the prompter's 38th actuation, square symbol 8 is elevated—say Our Father prayer, at each subsequent prompter actuation, that is the 39th through the 48th,—say a Hail Mary prayer, at the prompter's 49th actuation, hexagonal symbol 9 is elevated—say Our Father prayer, at each subsequent prompter actuation, that is the 50th through the 59th,—say a Hail Mary, at the prompter's 60th actuation, circular symbol 10 is elevated—say the Hail Holy Queen prayer.

The mechanical elevation of circular symbol 10 causes the engagement of each straight sided symbol 4, 5, 6, 7, 8, and 9, reset lever 17, by is corresponding tab 25 carried by circular symbol 10 skirt 24, and this causes the unfastened end of each reset lever 37 to rise and the symbol fastened on the opposite end of the symbol's lever 17 to be displaced downward into a recessed mode.

While the prompter is disposed with its straight sided symbols 4, 5, 6, 7, 8, and 9 in recessed mode and the circular symbol 10 elevated, and after the Hail Holy Queen prayer is recited, the circular symbol 10 is pressed down into its original recessed mode.

The prompter 1 is then ready to be used again.

Note 2

As an example of answering the typical day to day questions "where was I", that occurres when you are distracted while praying the Rosary, recommence by actuating the prompter 1 and if a symbol is not elevated, continue by saying a Hail Mary after each prompter 1 actuation until a symbol is elevated, and then, recognizing your place, follow the prompter's 1 sequence.

Note 3

Variation from the typical sequence of prayers said in reciting the Rosary could include reciting the Oh My Jesus prayer immediately after the 16th, 27th, 38th, and 49th symbol actuation, the prayer being interposed just before reciting the Our Father, at these actuations, and after the 60th symbol actuation, interposed just before reciting the Hail Holy Queen.

What is claimed is:

1. A hand held, hand operated, mechanical Rosary prayer sequence symbol prompter comprising:

counting symbol means including 6 straight sided non-similar geometric shaped symbols and 1 circular shaped symbol;

counting symbol support means including a vertical sided circular enclosure with a prompter actuating push button protruding from its side, and a structural frame that supports a vertical sided symbol fastening base ring to the interior surface of said vertical sided circular enclosure;

counting symbol fastening means including a hinge and tension spring assembly, for each straight sided symbol, that causes a symbol to tend to rotate clockwise toward the vertical sided circular enclosure, and that flexibly connects the symbol by one end to the top surface of said vertical sided symbol fastening base ring;

circular counting symbol support means including a vertical elongated flat headed rectangular shaped shaft that extends down from the underside of the symbol's circular top and that is carried in an elongated rectangular shaped vertical hole in said structural frame, the vertical elongated flat headed rectangular shaped shaft is supported to an up and down non-rotational travel capability;

counting wheel means comprising a wheel with 60 teeth and 60 V shaped notches that are radially spaced 6° apart, cut in said wheel's peripheral edge, each tooth corresponding to a prayer in the 60 sequenced prayers said in a recitation of the Rosary, and a semicircular, elongated, flat bottomed hold and release mechanism actuating displacement cam that is fastened disposed aligned radially on the top surface of said counting wheel means;

counting wheel support assembly means for supporting said counting wheel means to a horizontal rotational plane;

counting wheel mechanical rotational propulsion means comprised of a push button actuated wheel ratcheting mechanism that imparts rotational movement to the wheel, and a wheel rotational movement control pawl mechanism;

typical non-circular type symbol hold down and release means comprised of a symbol hold down hook, which is in the form of a short length of channel, fastened to the underside of said symbol, and a hold down and release mechanism assembly that while engaging said hook to hold a nonsimilar geometric shaped symbol, can be actuated by said counting wheel means to effect the upward release of the nonsimilar geometric shaped symbols into an inclined counting mode attitude;

non-circular counting symbol reset means including a reset lever that is hinge fastened by one end to the unfastened lower front end of each nonsimilar geometric shaped symbols and is also hinged near its midlength point that allows the lever to swing from the horizontal to the near vertical and engage a tab that is carried by said circular shaped symbol;

circular counting symbol hold down and release means comprised of a lever that is carried extending horizontally out of the lower end of said symbol's vertical shaft, and a mechanism assembly that while engaging said horizontal lever to hold said symbol down, can be actuated by said counting wheel means to effect the upward release of the symbol into an elevated counting mode attitude;

circular counting symbol non-circular counting symbol resetting means including a circular skirt that extends down from the underside of the circular symbol's circular top, and six tabs that extend horizontally out of the circular bottom of said skirt, aligned to engage the unfastened ends of the reset levers hinged to the 6 corresponding nonsimilar geometric shaped symbols; and a Rosary compartment means for carrying a Rosary on ones person, said compartment space being located in the bottom of said prompter.

2. The hand held, hand operated, mechanical Rosary prayer sequence symbol prompter of claim 1 wherein said typical non-circular type symbol hold down and release means further comprise noncircular symbol hold down and release mechanism elements that include, said hold down lever carried on a pivot pin that is supported to said structural frame by an angle support bracket, a lever tension spring pinned by one end to said angle and fastened by its other end to said hold down lever that it exerts clockwise turning pressure on said hold down lever, a pin that is carried by said support angle and limits the turning capacity of said hold down lever, and a rotatable disk mounted on the lower end of said hold down lever that can be deflected by said semicircular, elongated, flat bottomed hold and release mechanism actuating displacement cam, wherein engagement of said disk by said semicircular, elongated, flat bottomed hold and release mechanism actuating displacement cam, while said nonsimilar geometric shaped symbols are disposed held down under the influence of said non-circular symbol hold down and release mechanism elements, releases said symbol up into an inclined counting mode attitude.

3. The hand held, hand operated, mechanical Rosary prayer sequence symbol prompter of claim 1 wherein said circular counting symbol hold down and release means further comprise circular counting symbol hold down and release mechanism elements that include, a circular symbol hold down lever that is carried on a pivot pin that is supported to said structural frame by an angle bracket, a hook that is embodied in said circular counting symbol hold down lever, an angle supported lever turning limit pin, a lever tension spring that is carried on said pivot pin, and while pinned by one end to said support angle, exerts clockwise turning pressure through its other end on said lever's vertical edge, and a rotatable deflector disk mounted on the end of said lever, wherein said circular symbol, while disposed under the influence of said mechanism in a hold down mode, becomes released when said deflector disk is engaged by said counting wheel means, and said symbol's 6 horizontal tabs in their upward moving engagement, each with a corresponding noncircular symbol's reset lever, reset the 6 nonsimilar geometric shaped symbols back in a held down mode, and wherein said elevated circular shaped symbol is now counted, serving to identify the Hail Holy Queen, the last recited prayer of the Rosary, said circular shaped symbol then being pressed down into its reset held down mode.

4. The hand held, hand operated, mechanical Rosary prayer sequence symbol prompter of claim 1 wherein said counting wheel support assembly means further comprises a grooved bearing base plate that is bolted with its groove facing up, to a structural base plate that is supported to the interior sides of a prompter enclosure, a counting wheel that is contained horizontally through bolted between a vertical spacer post and a spacer cap, a bearing that is comprised of a circular plate with a skirt extending vertically down from its peripheral edge, through bolts and nuts fastening said post centered on the top of said bearing, a through bolt and nut that fastens said cap, wheel, post, and bearing, assembly in vertical alignment, a ring that is fastened by screws to the top outer circular surface of said grooved plate, said ring overlapping the outer peripheral edge of said assembly's bearing to contain said bearing's skirt in the groove of said groove bearing base plate, while said counting wheel support assembly means is mechanically rotated.

5. The hand held, hand operated, mechanical Rosary prayer sequence symbol prompter of claim 1 wherein said counting wheel mechanical rotational propulsion means is further comprised of wheel ratcheting mechanism elements that include a curved base plate that is fastened to the interior of said enclosure with the lengthwise dimension slot cut in its surface aligned with a corresponding same size slot cut in the enclosure side, a push button lever that is fastened to the interior side of said curved base plate by a hinge and tension spring assembly that exerts counterclockwise turning pressure on the push button lever, a short ratcheting lever that is fastened to the unfastened end of the push button lever by a hinge and tension spring assembly that exerts clockwise turning pressure on the ratcheting lever, and a modified S shaped bar that is fastened to said curved base plate with its unfastened end spaced a preset distance from said curved base plate to establish the travel distance limit of said push button lever, said preset distance amounting to the distance between the inside surface of said curved base plate and the inside surface of said S shaped bar's unfastened end, wherein, actuation, that is pressing said push button lever in, causes the short lever to engage a counting wheel V groove and facilitate pushing the wheel ratcheting mechanism elements into rotational movement, said wheel ratcheting mechanism elements traveling a distance approximately equivalent to said levers preset limited travel distance.

6. The hand held, hand operated, mechanical Rosary prayer sequence symbol prompter of claim 1 wherein said counting wheel mechanical rotational propulsion means is further comprised of wheel rotational movement control pawl mechanism elements that include a wheel holding pawl lever that is fastened at one end to the interior surface of a base plate by a hinge and tension spring assembly that exerts clockwise turning pressure on said wheel rotational movement control pawl mechanism to cause said wheel rotational movement control pawl mechanism to forcibly engage successive V notches in said wheel's peripheral edge as said counting wheel means is propelled, stabilizing and holding said counting wheel means in a non moving mode while it is under the influence of said wheel rotational movement control pawl mechanism.

7. The hand held, hand operated, mechanical Rosary prayer sequence symbol prompter of claim 1 wherein said Rosary compartment means further comprises a transparent compartment enclosing cover with a V shaped Rosary access opening cut out of it, wherein said transparent compartment enclosing cover is supported to a circular enclosure's interior surface by a circular frame.

8. The hand held, hand operated, mechanical Rosary prayer sequence symbol prompter of claim 7 wherein said V shaped Rosary access opening is covered by a V shaped transparent gate that is larger than said V shaped Rosary access opening and is hinge fastened on a pin that is set in and projects out of the center of said transparent compartment enclosing cover.

9. The hand held, hand operated, mechanical Rosary prayer sequence symbol prompter of claim 8 wherein said hinged gate can be swung or moved over said V shaped Rosary access opening, said transparent compartment enclosing cover carrying a plastic mound that is cast on the surface of said transparent compartment enclosing cover, spaced from the edge of said V shaped Rosary access opening, and said V shaped transparent gate carries a corresponding raised rectangularly shaped bar that is aligned radially with respect to said gate's pin and fastened on the compartment side of said V shaped transparent gate, wherein said V shaped transparent gate bar encounters said plastic mound when said V shaped transparent gate is swung over said compartment V shaped cover opening and snaps over said plastic mound, causing said V shaped transparent gate to fall into a stabilized, held, closed mode, to achieve a closed Rosary carrying compartment.

10. The hand held, hand operated, mechanical Rosary prayer sequence symbol prompter of claim 1 wherein said circular counting symbol hold down and release means further comprises a symbol recoil spring that is carried encircling said vertical shaft disposed between the underside of said circular shaped symbol top and the top of said structural frame so that it typically pushes said circular shaped symbol to the point where the underside of said structural frame is engaged by a travel limiting lever horizontally extending from the vertical shaft.

* * * * *